US010501243B2

(12) United States Patent
Mulvaney et al.

(10) Patent No.: US 10,501,243 B2
(45) Date of Patent: Dec. 10, 2019

(54) VENT ASSEMBLY AND RESERVOIRS INCLUDING THE SAME

(71) Applicant: 3M INNOVATIVE PROPERTIES COMPANY, St. Paul, MN (US)

(72) Inventors: Claudia M. Mulvaney, Woodbury, MN (US); Brian E. Duncan, St. Paul, MN (US); Daniel E. Siltberg, White Bear Township, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 742 days.

(21) Appl. No.: 14/416,189

(22) PCT Filed: Jul. 25, 2013

(86) PCT No.: PCT/US2013/051953

§ 371 (c)(1),
(2) Date: Jan. 21, 2015

(87) PCT Pub. No.: WO2014/018710

PCT Pub. Date: Jan. 30, 2014

(65) Prior Publication Data

US 2015/0203259 A1 Jul. 23, 2015

Related U.S. Application Data

(60) Provisional application No. 61/676,392, filed on Jul. 27, 2012.

(51) Int. Cl.

| | |
|---|---|
| ***B65D 47/32*** | (2006.01) |
| ***B05B 7/24*** | (2006.01) |
| ***B65D 41/04*** | (2006.01) |

(52) U.S. Cl.

CPC ..... *B65D 47/32* (2013.01); *B05B 7/2408* (2013.01); *B05B 7/2478* (2013.01); *B65D 41/0471* (2013.01)

(58) Field of Classification Search

CPC ..... B65D 51/1616; B65D 51/16; B65D 51/1661; B65D 51/1683; B65D 51/1644;

(Continued)

(56) References Cited

U.S. PATENT DOCUMENTS

| | | | | |
|---|---|---|---|---|
| 3,524,589 A | | 8/1970 | Pelton, Jr. | |
| 5,038,959 A | * | 8/1991 | Patel | A47G 19/14 220/303 |

(Continued)

FOREIGN PATENT DOCUMENTS

| | | |
|---|---|---|
| DE | 8702559 | 10/1987 |
| EP | 0954381 | 11/1999 |

(Continued)

OTHER PUBLICATIONS

International Search Report for PCT International Application No. PCT/US2013/051953, dated Oct. 31, 2013, 4 pgs.

*Primary Examiner* — Chun Hoi Cheung
*Assistant Examiner* — Brijesh V. Patel

(57) ABSTRACT

Vent assemblies movable between a vented position and a non-vented position are described along with reservoirs in which the vent assemblies may be used. The vent assemblies each include an aperture and a closure member. The closure member is configured for movement along a cam surface to generate a compressive force such that a sealing surface on the closure member is forced against the wall of the reservoir and over the aperture such that the vent assembly is in the non-vented position. The closure member movement may be, e.g., rotational or linear (i.e., translational) when moving between the vented and unvented positions.

21 Claims, 8 Drawing Sheets

(58) Field of Classification Search
CPC ..... B65D 43/20; B65D 43/12; B65D 50/041; B65D 50/046; B65D 2205/00; B05B 7/2408; B05B 7/2478; B05B 7/2481
USPC .... 220/217, 223, 307, 311, 314, 373, 345.1, 220/345.4, 345.6; 239/302, 379, 316, 320
See application file for complete search history.

(56) References Cited

U.S. PATENT DOCUMENTS 5,148,936 A 9/1992 Degrow
5,750,967 A * 5/1998 Sprauer, Jr. ..... A47J 27/04 220/367.1
6,257,450 B1 7/2001 Jackson et al.
7,090,090 B2 * 8/2006 Ohyama ..... A47J 36/027 220/203.09
7,090,148 B2 8/2006 Petrie
7,175,110 B2 2/2007 Vicentini
7,416,140 B2 8/2008 Camilleri
7,614,571 B2 11/2009 Camilleri
7,810,744 B2 10/2010 Schmon
7,819,341 B2 10/2010 Schmon
7,823,806 B2 11/2010 Schmon
8,857,647 B2 * 10/2014 Nakamura ..... B65D 43/0231 215/332
2002/0066732 A1 * 6/2002 Ogino ..... A47J 45/063 220/203.04
2002/0190066 A1 12/2002 Hardigg
2006/0243756 A1 * 11/2006 Kawakita ..... B65D 1/06 222/478
2007/0108313 A1 * 5/2007 Bouic ..... B05B 7/2408 239/345
2007/0221754 A1 9/2007 Gehrung
2008/0149638 A1 6/2008 Van Hees et al.
2012/0291890 A1 * 11/2012 Pan ..... B05B 7/2408 137/544

FOREIGN PATENT DOCUMENTS

EP 1658143 5/2006
EP 1990099 11/2008
JP 5-68862 9/1993
WO WO 2004-052552 6/2004
WO WO 2005-077543 8/2005
WO WO 2007-051123 5/2007

* cited by examiner

VENT ASSEMBLY AND RESERVOIRS INCLUDING THE SAME

CROSS REFERENCE TO RELATED APPLICATIONS

This application is a national stage filing under 35 U.S.C. 371 of PCT/US2013/051953, filed Jul. 25, 2013, which claims priority to U.S. Provisional Application No. 61/676,392, filed Jul. 27, 2012, the disclosure of which is incorporated by reference in its/their entirety herein.

Vent assemblies and reservoirs including the vent assemblies are disclosed herein. The vent assemblies are movable between a vented position and an unvented position.

Reservoirs containing liquids often require venting so that air can enter the reservoir as liquid is removed therefrom. One example of reservoirs that may require venting are those used to deliver liquid to spray guns. Spray guns are widely used in, e.g., vehicle body repair shops when spraying a vehicle with liquid coating, e.g., primer, paint and/or clearcoat. Typically the spray gun includes a body, nozzle and trigger. The liquid coating is typically supplied to the spray gun by a reservoir attached to the spray gun.

The use of disposable reservoirs for the preparation and spraying of liquid materials in, e.g., vehicle body repair shops, has become an accepted practice to contribute to a quick turnaround and high throughput. The disposable reservoirs typically include a lid to close the reservoir and to provide a structure that can be attached to a spray gun and through which liquid is delivered to the spray gun. During use, the reservoir is typically placed in an orientation such that the liquid contained therein flows to the spray gun by the force of gravity. In such reservoirs, a vent is typically used to prevent the formation of a vacuum in the reservoir as liquid is delivered to the spray gun, which can contribute to maintaining a consistent liquid flow to the spray gun. Potential examples of some reservoirs in which vents may be needed are described in U.S. Pat. No. 7,090,148 B2 (Petrie et al.) and EP Patent EP 0954381 B2 (Joseph et al.).

One potential problem of vented reservoirs is, however, leakage of the liquid through the vent or vents as the reservoir is being filled, when it is in storage, etc.

SUMMARY

The vent assemblies that may be used in reservoirs as described herein are movable between a vented position and a non-vented position. The vent assemblies each include an aperture and a closure member. The closure member is configured for movement along a cam surface to generate a compressive force such that a sealing surface on the closure member is forced against the wall of the reservoir and over the aperture such that the vent assembly is in the non-vented position. The closure member movement may be, e.g., rotational or linear (i.e., translational) when moving between the vented and unvented positions.

When in the vented position, the vent assembly allows air to pass through the aperture so that it can enter the reservoir as liquid is removed from the reservoir (e.g., as liquid is delivered to a spray gun). The vent assemblies described herein are movable between a vented position and an unvented position because, in one or more embodiments, the reservoir may be filled with liquid while it is in an orientation in which liquid in the reservoir would leak through the vent if the vent were always open (i.e., in the vented position). For example, in one or more embodiments, the reservoir may be filled while it is in an orientation in which the liquid used to fill the reservoir is located above the vent assembly (relative to the direction of gravitational forces acting on the liquid). In such an arrangement, the liquid could potentially leak through the vent assembly unless the vent assembly can be closed or placed in an unvented position as described herein. In such arrangements, changing the orientation of the reservoir (e.g., inverting the reservoir) can place the vent assembly above the liquid so that the liquid does not typically leak through the vent assembly when the vent assembly is in the vented position. If, for example, the reservoir is inverted for attachment to a spray gun, the vent assembly is preferably located above the liquid being dispensed.

In one or more embodiments, a vent assembly as described herein may include: an aperture formed in a wall of a reservoir, wherein the reservoir defines an interior volume, and wherein the aperture is in fluid communication with the interior volume of the reservoir; a closure member retained on the wall of the reservoir proximate the aperture, wherein the closure member is configured for movement between a vented position and an unvented position, wherein the closure member comprises a sealing surface that closes the aperture when the closure member is in the unvented position, and wherein the sealing surface does not close the aperture when the closure member is in the vented position; a closure member retainer, wherein the closure member retainer is configured to retain the closure member on the wall of the reservoir when the closure member is in the vented position; and a cam surface configured to generate a compressive force on the closure member when the closure member is moved into the unvented position, wherein the compressive force forces the sealing surface of the closure member against the against the wall of the reservoir when the sealing surface is positioned over the aperture.

In one or more embodiments, the closure member is configured for linear movement between the vented position and the unvented position.

In one or more embodiments, the closure member is configured for rotation about an axis extending through the wall of the reservoir when moving between the vented position and the unvented position.

In one or more embodiments, the cam surface is located between the closure member and the wall of the reservoir, wherein rotation of the closure member from the vented position to the unvented position generates a compressive force between the closure member retainer and the cam surface such that the sealing surface of the closure member is forced against the against the wall of the reservoir when the sealing surface is positioned over the aperture.

In one or more embodiments, the closure member is mounted on a post extending from the wall of the reservoir, wherein the closure member is configured for rotation on the post; and wherein the closure member retainer is located on the post and configured to retain the closure member on the post when the closure member is in the vented position, and further wherein the compressive force is generated between the closure member retainer and the cam surface when the sealing surface is positioned over the aperture. In one or more embodiments, the closure member retainer comprises a shoulder extending outwardly from the post relative to the axis, and in one or more embodiments, the closure member comprises an inner surface facing the post and a top surface facing away from the wall of the reservoir, wherein the closure member comprises a stepped transition between the inner surface and the top surface wherein a top edge of the inner surface does not coincide with an inner edge of the top surface of the closure member. In one or more embodiments, the shoulder of the closure member retainer contacts the top edge of the inner surface of the closure member when the closure member is in the unvented position.

In one or more embodiments, the aperture extends through the cam surface. In one or more embodiments, the cam surface comprises an aperture surface portion that is located in a plane that is perpendicular to the axis about which the closure member rotates, and wherein the aperture extends through the aperture surface portion of the cam surface.

In one or more embodiments, the reservoir comprises an opening and a detachable lid configured to close the opening when the lid is attached to the reservoir over the opening. In one or more embodiments, the reservoir comprises a base located opposite the opening, and wherein the aperture is located in the base. In one or more embodiments, the aperture of the vent assembly is located in the lid.

In one or more embodiments, the vent assembly comprises a stop configured to limit movement of the closure member in one direction when the closure member is in the unvented position. In one or more embodiments, the stop protrudes from the wall of the reservoir. In one or more embodiments, the stop is located proximate the cam surface.

In one or more embodiments, the vent assembly comprises a plurality of apertures and wherein the closure member comprises a plurality of sealing surfaces, wherein each aperture of the plurality of apertures is closed by a sealing surface of the plurality of sealing surfaces when the closure member is in the unvented position. In one or more embodiments, the closure member comprises a plurality of relief surfaces, wherein a relief surface is positioned above each aperture of the plurality of apertures when the closure member is in the vented position. In one or more embodiments, the vent assembly comprises a plurality of cam surfaces, and wherein each aperture of the plurality of apertures is located in a cam surface of the plurality of cam surfaces, and further wherein each aperture of the plurality of apertures is closed by a sealing surface of the plurality of sealing surfaces when the closure member is in the unvented position.

In one or more embodiments, a method of opening and closing a vent assembly as described herein may include: moving a closure member between an unvented position and a vented position, wherein a sealing surface on the closure member closes the aperture when the closure member is in the unvented position, and wherein in the vented position, the sealing surface does not close the aperture; and wherein movement of the closure member from the vented position to the unvented position generates a compressive force on the closure member such that the sealing surface of the closure member is forced against the against the wall of the reservoir when the sealing surface is positioned over the aperture.

In one or more embodiments, a method of opening and closing a vent assembly as described herein may include: rotating a closure member mounted on a post extending from a wall of a reservoir, wherein the closure member rotates on the post about an axis extending through the post and the wall, wherein the closure member rotates between an unvented position and a vented position, wherein in the unvented position a sealing surface on the closure member closes the aperture, and wherein in the vented position, the sealing surface does not close the aperture; and wherein rotation of the closure member from the vented position to the unvented position generates a compressive force on the closure member between a closure member retainer on the post and a cam surface on the wall of the reservoir such that the sealing surface of the closure member is forced against the against the wall of the reservoir when the sealing surface is positioned over the aperture. In one or more embodiments, the closure member retainer comprises a shoulder located on an exterior surface of the post, and wherein the closure member is compressed between the shoulder and the cam surface when the closure member is in the unvented position. In one or more embodiments, the closure member comprises an inner surface facing the post and a top surface facing away from the wall of the reservoir, wherein the closure member comprises a stepped transition between the inner surface and the top surface wherein a top edge of the inner surface does not coincide with an inner edge of the top surface of the closure member, and further wherein the shoulder of the closure member retainer contacts the top edge of the inner surface of the closure member when the closure member is in the unvented position.

As used herein, the term "liquid" refers to all forms of flowable materials including, e.g., flowable materials that can be applied to a surface using a spray gun (whether or not they are intended to color the surface) including (without limitation) paints, primers, base coats, lacquers, varnishes and similar paint-like materials as well as other materials such as adhesives, sealers, fillers, putties, powder coatings, blasting powders, abrasive slurries, mold release agents and foundry dressings which may be applied in atomized or non-atomized form depending on the properties and/or the intended application of the material and the term "liquid" is to be construed accordingly.

The words "preferred" and "preferably" refer to embodiments described herein that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used herein and in the appended claims, the singular forms "a," "an," and "the" include plural referents unless the context clearly dictates otherwise. Thus, for example, reference to "a" or "the" component may include one or more of the components and equivalents thereof known to those skilled in the art. Further, the term "and/or" means one or all of the listed elements or a combination of any two or more of the listed elements.

It is noted that the terms "comprises" and variations thereof do not have a limiting meaning where these terms appear in the accompanying description. Moreover, "a," "an," "the," "at least one," and "one or more" are used interchangeably herein.

Relative terms such as left, right, forward, rearward, top, bottom, side, upper, lower, horizontal, vertical, and the like may be used herein and, if so, are from the perspective observed in the particular figure. These terms are used only to simplify the description, however, and not to limit the scope of the invention in any way.

The above summary is not intended to describe each embodiment or every implementation of the reservoirs and associated vent assemblies described herein. Rather, a more complete understanding of the invention will become apparent and appreciated by reference to the following Description of Illustrative Embodiments and claims in view of the accompanying figures of the drawing.

DESCRIPTION OF ILLUSTRATIVE EMBODIMENTS

Figure 1:
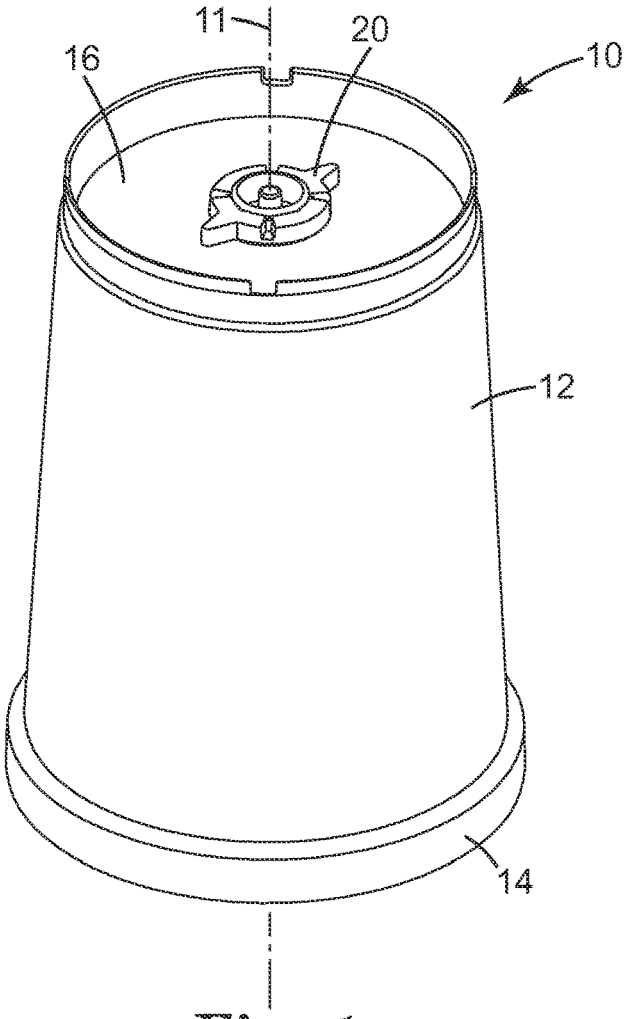
FIG. 1 is a perspective view of one illustrative embodiment of a vent assembly in a reservoir as described herein.

In the following description of illustrative embodiments, reference is made to the accompanying figures of the drawing which form a part hereof, and in which are shown, by way of illustration, specific embodiments. It is to be understood that other embodiments may be utilized and structural changes may be made without departing from the scope of the present invention.

The vent assemblies and reservoirs described herein may be used in a wide variety of environments in which a liquid is provided in a reservoir and dispensed therefrom in a manner that requires venting to avoid the formation of a vacuum that could inhibit removal of the liquid. One example of such an environment is in a liquid spray delivery system in which a reservoir containing liquid to be dispensed is mounted on a liquid spray gun. Although the reservoirs may be attached directly to the spray gun, in one or more embodiments liquid in the reservoirs described herein could be delivered to the spray gun through a supply line (e.g., hose, tubing, etc.) that extends from the reservoir to the spray gun. The liquid spray guns with which the reservoirs described herein may be used may preferably be sized for use as a hand-held spray gun and may be used in methods that involve the spraying of one or more selected liquids.

One illustrative embodiment of a vent assembly as described herein is depicted in connection with FIGS. 1-10. Referring to FIG. 1, the vent assembly 20 is located in a wall of the reservoir 10 which includes a container 12, a detachable lid 14 located over an opening defined by the container 12. The reservoir 10 also includes a base 16 located on an opposite end of the container 12 from the opening. The detachable lid 14 (which can be removed from the opening of the container 12 so that, e.g., the reservoir 10 can be filled with a liquid through the opening) closes the opening in the container 12 when the lid 14 is attached to the container 12 over the opening. The container 12 may be constructed of inexpensive polymeric materials such as, e.g., polypropylene, etc., although the container bodies may be constructed of any material that is suitable for containing the liquid with which the container assembly 10 is to be used.

Figure 15:
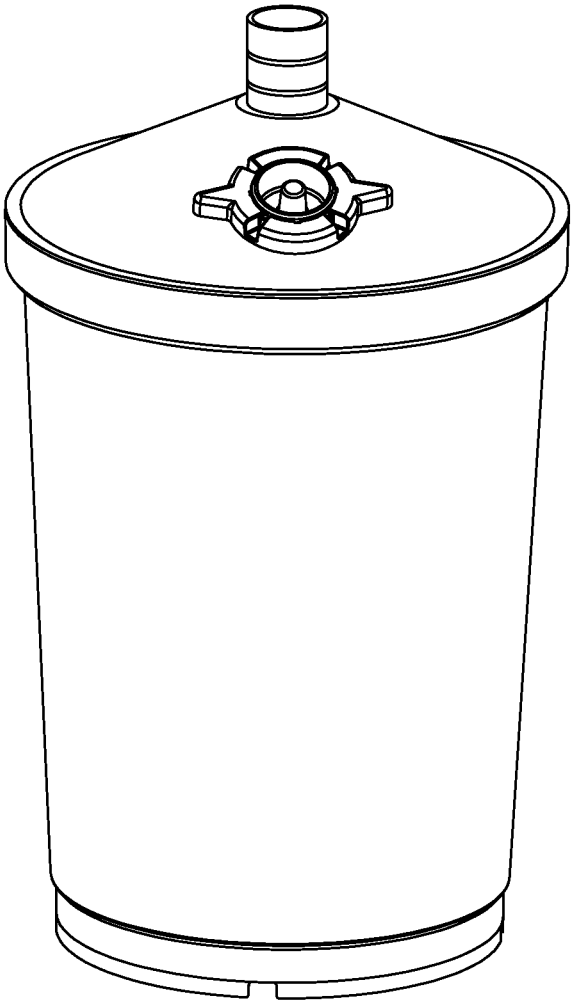
FIG. 15 is a perspective view of another illustrative embodiment of a vent assembly in a reservoir, as described herein.

In the illustrative embodiment depicted in FIG. 1 the vent assembly 20 is located in the base 16 of the reservoir 10. Although the vent assembly 20 in the illustrative embodiment depicted in FIG. 1 is located in the base 16, the vent assemblies described herein could be located in any wall of the reservoir 10 with the base 16 being only one example of a wall in which the vent assembly 20 could be located. For example, in one or more embodiments, the vent assembly 20 could be located in any wall forming a part of the container 12 or the lid 14, as can be seen in FIG. 15. The vent assembly 20 may be in a location that is typically positioned above the liquid in the reservoir 10 (relative to the force of gravity) when the reservoir 10 is being used to dispense the liquid contained therein. Furthermore, although the reservoir 10 includes only one vent assembly 20, in one or more embodiments, the reservoir 10 could include two or more vent assemblies and those vent assemblies could be located in the same wall or in different walls of the reservoir 10.

As described herein, the vent assembly 20 is movable between a vented position and an unvented position. The vent assembly 20 is typically placed in the unvented position when the reservoir 10 is being filled with a liquid through, e.g., the opening in the container 12. Although not depicted in FIG. 1, the lid 14 (or any other suitable portion of the reservoir 10) may, in one or more embodiments, include structure, such as ports, etc., that may facilitate connection of the reservoir 10 to, e.g., a spray gun for dispensing a liquid contained therein to the spray gun for application to a surface. By placing the vent assembly 20 in the unvented position, leakage of the liquid used to fill the reservoir 10 through the vent assembly 20 is typically prevented when the liquid is located above the vent assembly 20.

The reservoir 10 may, in one or more embodiments, be inverted during use (when, e.g., attached to a spray gun) such that the base 16 is located above the lid 14. That change in orientation places the vent assembly 20 above the liquid in the reservoir 10. Movement of the vent assembly 20 from the unvented position to the vented position when the vent assembly 20 is located above the liquid in the reservoir 10 allows for entry of air into the volume of the reservoir 10 without allowing the liquid to leak through the vent assembly 20.

Figure 2:
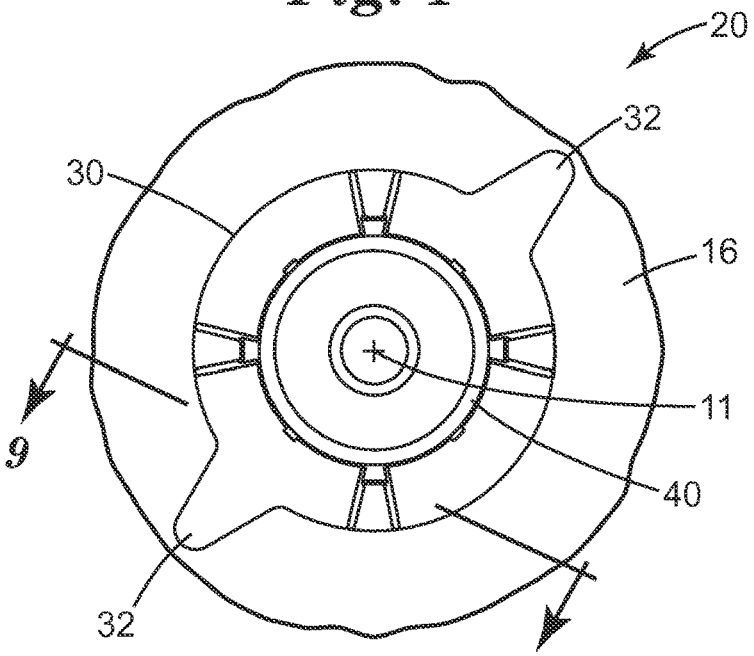
FIG. 2 is a plan view of the vent assembly of FIG. 1.

FIGS. 2-10 depicted various components and features of one illustrative embodiment of a vent assembly 20 that may be used in connection with the reservoirs 10 as described herein. Referring to FIG. 2, the vent assembly 20 includes a closure member 30 mounted on a post 40 that, in the illustrative embodiment, extends from the base 16 of the reservoir 10 (although, as discussed herein, the vent assembly could be located in any wall of the reservoir). Although the depicted embodiment of container 12 is generally cylindrical such that it includes a cylindrical wall and a base 16 (which is also a wall as the term "wall" is used herein), other reservoirs with which the vent assemblies described herein may be used may, for example, not include a base, may have only one wall, may have two, three or more walls, etc. Essentially, the reservoirs with which the vent assemblies described herein may be used can take any suitable shape that includes at least one wall that defines a volume in which liquid can be contained and in which a vent assembly as described herein can be located.

The closure member 30 is configured for rotation on the post 40 about axis 11 that extends through the post 40 and the base 16 of the reservoir 10. As discussed herein the closure member 30 is configured for rotation about the axis 11 between a vented position and an unvented position.

The closure member 30 may include extensions 32 to assist the user in rotating the closure member 30 by hand. It should, however, be understood that the closure member 30 may be designed for rotation using a tool designed for that function. Further, extensions 32 represent only one example of many different structures that could be used to facilitate manual rotation of the closure member 30 about the post 40.

Figure 3:
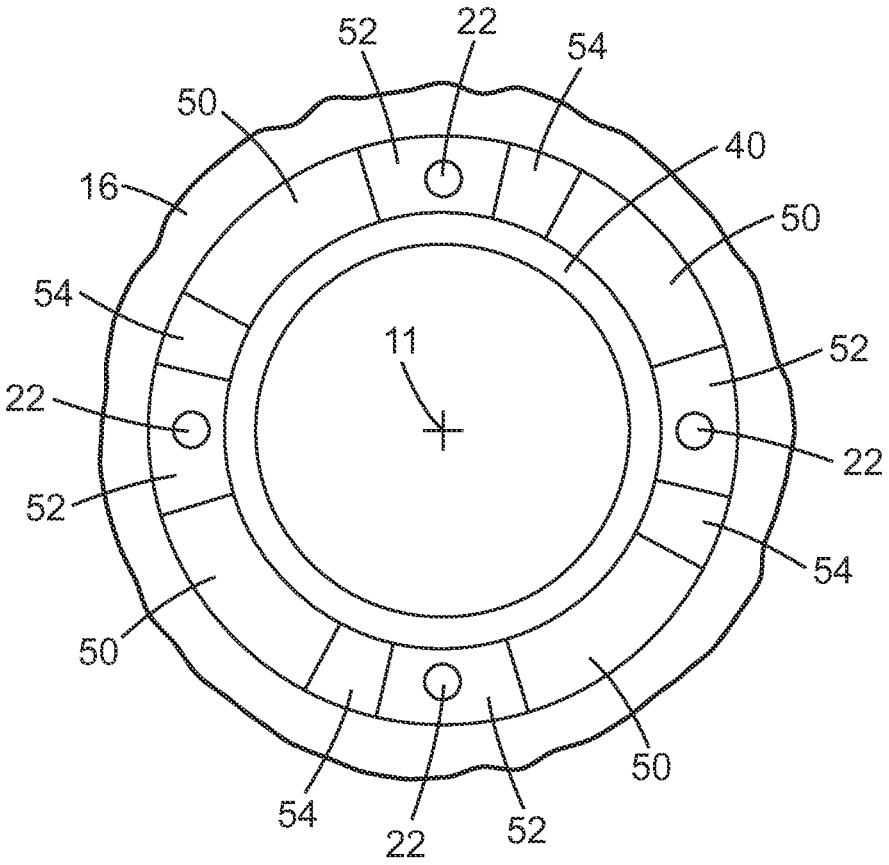
FIG. 3 is a plan view of the vent assembly of FIGS. 1 and 2 with the closure member removed to expose the cam surfaces and apertures of the vent assembly.
Figure 4:
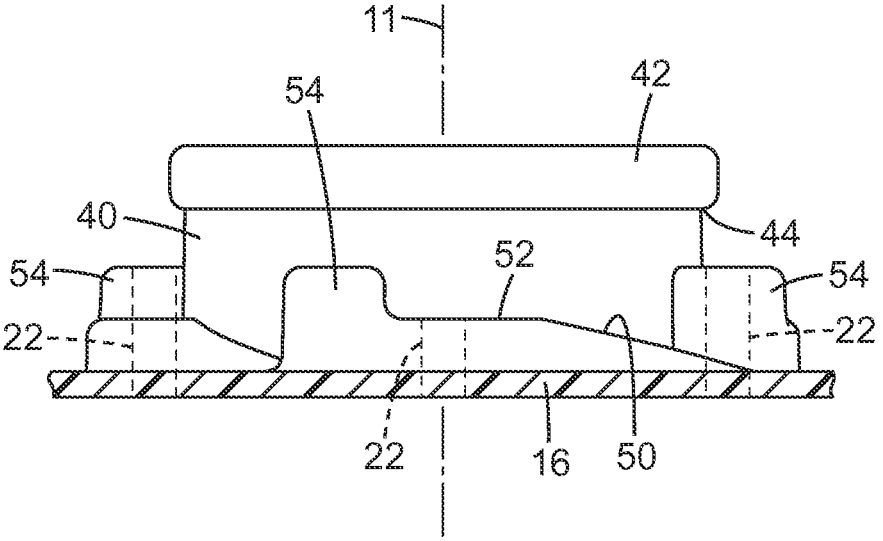
FIG. 4 is a side view of FIG. 3.

FIGS. 3 and 4 depict in the post 40 and associated features with the closure member 30 removed from the vent assembly 20. Referring to FIG. 3, the post 40, through which axis 11 extends, is surrounded by features that cooperate with the closure member 30 to provide both the vented position and the unvented position of the vent assembly 20. Those features include cam surfaces 50 which terminate in aperture surface portions 52. In the illustrative embodiment, each of the aperture surface portions 52 includes an aperture 22 located therein such that the aperture 22 extends through the aperture surface portion 52 of the cam surface 50. The aperture 22 extends through the base 16 and allows air to enter the container 12 when the aperture 22 is not blocked or otherwise closed by features on the closure member 30 as will be described herein. Although the illustrative embodiment includes four apertures, it should be understood that vent assemblies 20 as used in the reservoirs 10 described herein may include as few as one aperture or any other number of apertures selected based on many different factors that relate to the venting performance required. The features depicted in FIGS. 3 and 4 further include stops 54 that are provided to limit rotation of the closure member 30 about the post 40 when the vent assembly 20 is in the unvented position.

Also depicted in FIG. 4 are a closure member retainer 42 located on the post 40 above the cam surfaces 50 and aperture surface portions 52. The closure member retainer 42 includes a shoulder 44 that extends outwardly from the post 40 (where outwardly is radially away from the axis 11). The shoulder 44 faces the base 16 and the cam surfaces 50 and their aperture surface portions 52. The closure member retainer 42 preferably interacts with the closure member 30 on the post 40 to retain the closure member 30 on the post 40 when the vent assembly 20 is in the vented position. That function is, in the illustrative embodiment of FIGS. 2-10, provided by a mechanical interference between the closure member 30 and the closure member retainer 42. The closure member retainer 42 also preferably interacts with the closure member 30 to provide a compressive force that assists in closing or sealing of the apertures 22 in the aperture surface portions 52 as is described herein.

The cam surfaces 50 preferably rise gradually from the base 16 to the aperture surface portions 52 so that relatively smooth operation of the closure member 30 is achieved as closure member 30 is rotated from the vented position to the unvented position and vice versa. Rotation of the sealing surfaces of the closure member 30 past aperture surface portions 52 is, in the illustrative embodiment, prevented by stops 54 positioned adjacent the aperture surface portions 52. The stops 54 are only one embodiment of many different structures that could be used to limit rotation of the closure member 30 about the post 40. For example, in one or more embodiments, stops may be located on the base 16 for interaction with extensions 32 (see, e.g., extensions 32 in FIG. 2) to limit rotation of the closure member 30 about the axis 11 extending through post 40.

Although not necessarily required, it may be advantageous to provide cam surfaces 50 having aperture surface portions 52 that are relatively flat and that are located in a plane that is perpendicular to axis 11 about which closure member 30 rotates. That orientation may as discussed herein, provide improved closure of the apertures 22 by the closure member 30.

In one or more embodiments, it may be preferred that all of the features depicted in FIGS. 3 and 4 be molded of the same material, e.g., a thermoplastic such as polypropylene. Such a construction is not, however, required and one or more of the different features may be constructed of different materials that are joined or connected together by any suitable technique or combination of techniques. In one or more embodiments, the additional material used to construct the cam surfaces 50, aperture surface portions 52, and stops 54 may, along with post 40, provide additional rigidity to the base 16 that facilitates proper operation and closure of the apertures 22.

Figure 5:
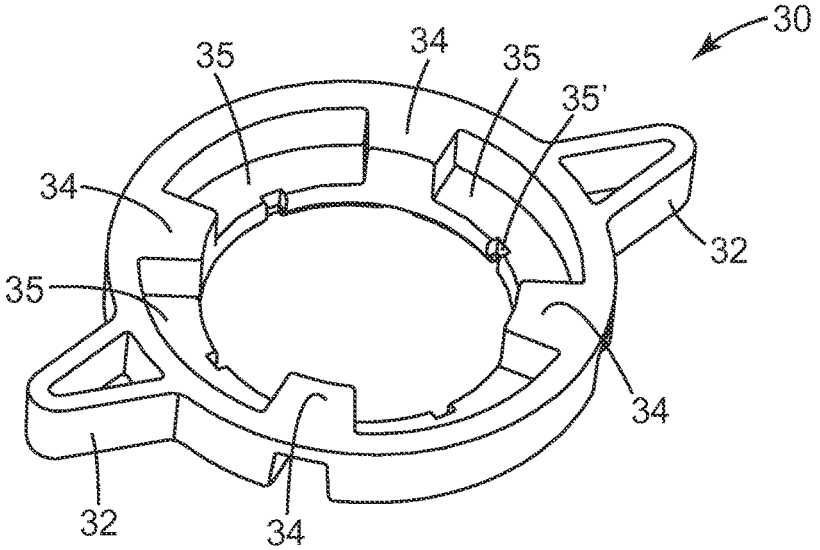
FIG. 5 is a bottom plan view of the closure member used in the vent assemblies of FIGS. 1 and 2.
Figure 6:
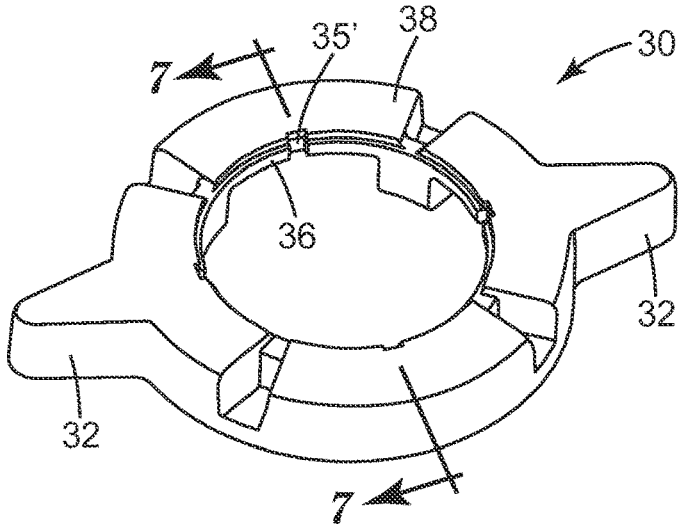
FIG. 6 is a top plan view of the closure member used in the vent assemblies of FIGS. 1 and 2.
Figure 7:
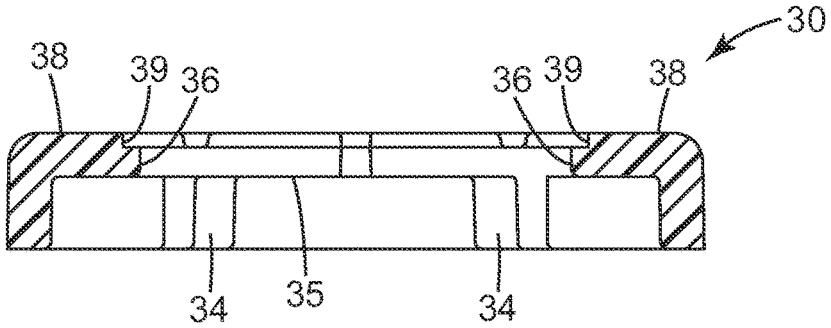
FIG. 7 is a cross-sectional view of the closure member of FIG. 6 taken along line 7-7 in FIG. 6.

Referring now to FIGS. 5-7, various features of the illustrative embodiment of a closure member 30 will be described. FIG. 5 is a view of the underside or bottom surface of the closure member 30, i.e., the surface of the closure member 30 and that faces the base 16 of the reservoir assembly 10. The extensions 32 are depicted in FIG. 5 along with sealing surfaces 34 and relief surfaces 35 that are positioned between the sealing surfaces 34. Rotation of the closure member 30 about a post 40 as described herein moves the sealing surfaces 34 and relief surfaces 35 such that, when the closure member 30 is in the vented position, the relief surfaces 35 are located over the apertures 22. Because the relief surfaces 35 do not close the apertures 22, air is allowed to pass through the apertures 22 into the container 12 of the reservoir assembly 10. As depicted, the relief surfaces 35 may optionally include one or more supplemental notches 35' that may further enhance the movement of air through the vent assembly. When the closure member 30 is in the unvented position, the sealing surfaces 34 are positioned over the apertures 22 such that air is prevented or at least severely restricted from passing through the apertures 22. Another characterization of the effect of locating sealing surfaces 34 over apertures 22 is that sealing surfaces 34 preferably form a liquid-tight seal over the apertures 22 such that liquid within the container 22 does not pass through the apertures 22.

Although the closure members 30 used in vent assemblies 20 as described herein will typically include a number of sealing surfaces 34 that match the number of apertures 22, such a relationship is not necessarily required. For example, in one or more embodiments, the closure member 30 may include a single sealing surface that extends completely or nearly completely about the circumference of the closure member 30 if, when the closure member 30 is in the vented position, the sealing surface 34 is not in a position to close the apertures 22. For example, the closure member 30 may be only loosely retained on the post such that air can pass between the sealing surface 34 into the apertures 22 even when the closure member 30 does not include relief surfaces 35.

Figure 8:
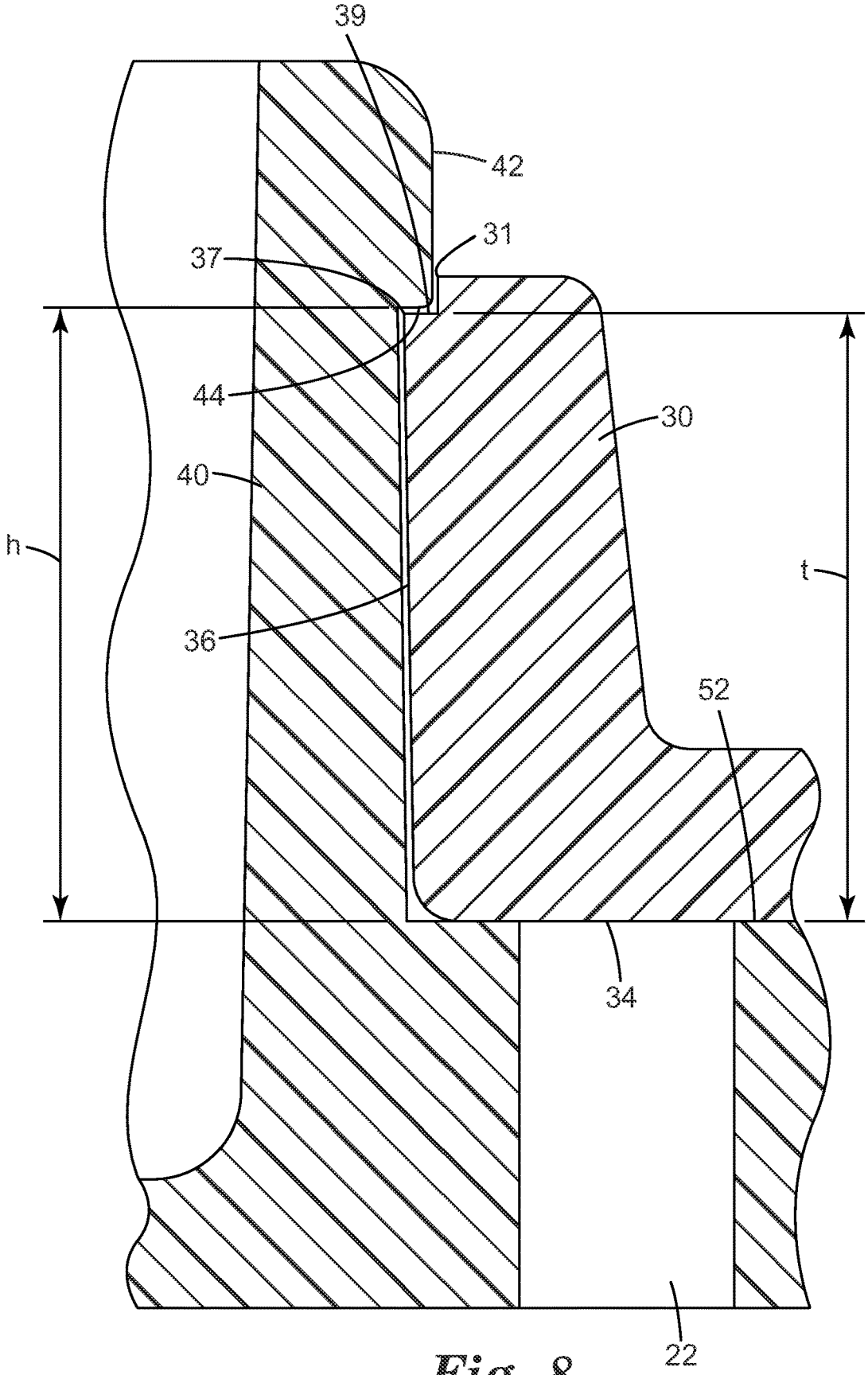
FIG. 8 is an enlarged cross-sectional view of the interaction between the closure member sealing surface and aperture and the closure member retainer on the post in the closure member depicted in FIGS. 1 and 2.

Referring to FIGS. 6-8 depict other features that may be included in the closure members 30 of the vent assemblies 20 as described herein to provide improved sealing or closure of the apertures 22. In particular, the closure member 30 may include an inner surface 36 that faces the post 40 when the closure member 30 is mounted on the post 40. The closure member 30 may also include a top surface 38 that faces away from the base 16 of the reservoir 10. The closure member 30 may include a stepped transition 39 between the inner surface 36 and the top surface 38 that cooperates with the closure member retainer 42. In the stepped transition 39 between the inner surface 36 and the top surface 38, a top edge 37 of the inner surface 36 does not coincide with an inner edge 31 of the top surface 38 of the closure member 30.

The relationship between the stepped transition 39 of the closure member 30 and the closure member retainer 42 may be best seen in the enlarged cross-sectional view of FIG. 8. As depicted there, the shoulder 44 of the closure member retainer 42 faces the aperture surface portion 52 (and, therefore, the base 16) and the lip 44 interacts with the stepped transition 39, preferably in a manner that provides for compression of the sealing surface 34 against the aperture surface portion 52 around the opening of aperture 22 in the aperture surface portion 52.

In the illustrative embodiment depicted in FIG. 8, the height h of the closure member retainer 42 above the aperture surface portion 52 may preferably be smaller than the thickness t of the closure member 30 located between the shoulder 44 of the closure member retainer 42 and the aperture surface portion 52 (although it should be understood that the opposite relationship is depicted in FIG. 8 only for clarity, i.e., in FIG. 8 h>t for clarity). The result of that difference preferably provides for a compressive force that forces the sealing surface 34 against the aperture surface portion 52. That compressive force may preferably provide two functions including a force that improves closure of the aperture 22 and that assists in retaining the closure member 30 in the unvented position due to friction generated between the sealing surface 34 and the aperture surface portion 52. In one or more embodiments, the compressive force may be generated when the shoulder 44 of the closure member retainer 42 contacts the top edge 37 of the inner surface 36 of the closure member 30 when the closure member 30 is in the unvented position.

Figure 9:
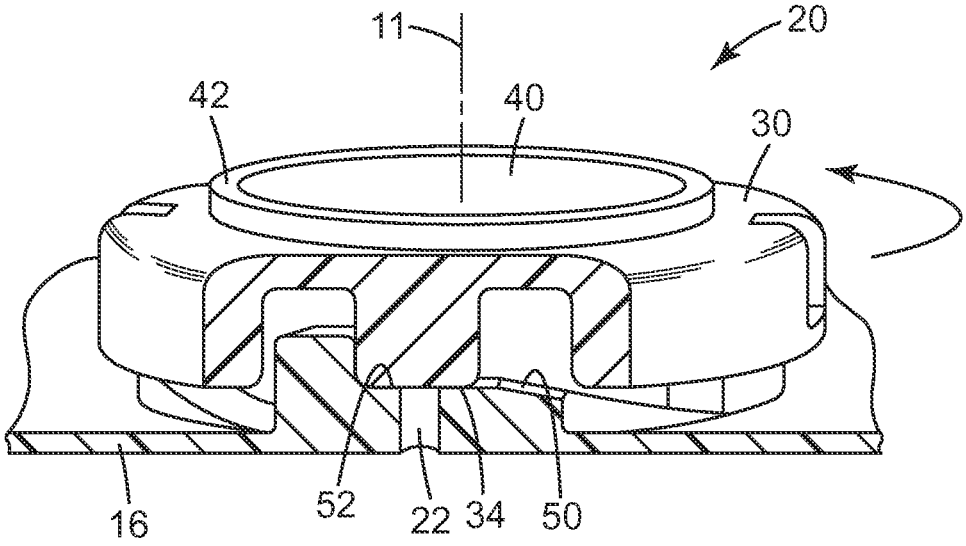
FIG. 9 is an enlarged perspective view of the vent assembly of FIGS. 1 and 2 in the non-vented position. The view of FIG. 9 is a partial cross-sectional view taken along line 9-9 in FIG. 2.
Figure 10:
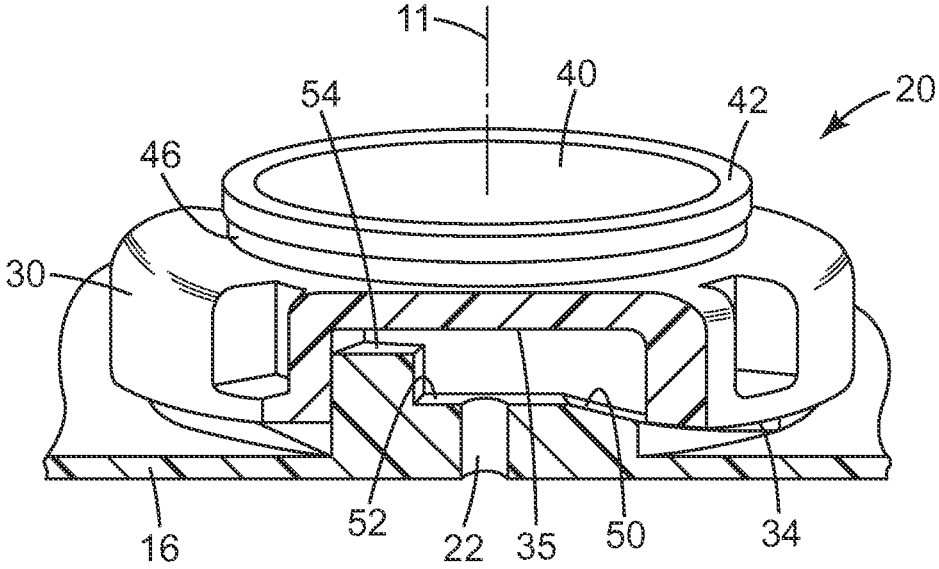
FIG. 10 is a view of the vent assembly of FIG. 9 after rotation of the closure member to the vented position.

Referring now to FIGS. 9-10, operation of the closure member 30 is depicted with the closure member 30 being located in the unvented position in FIG. 9 and in the vented position in FIG. 10. In the unvented position depicted in FIG. 9, the sealing surface 34 is positioned over the aperture surface portion 52 such that the aperture 22 is blocked by sealing surface 34. In the vented position depicted in FIG. 10, a relief surface 35 is located over the aperture 22 such that air can pass through aperture 22 in into the container as described herein.

In both FIGS. 9 and 10, interaction between the closure member retainer 42 on post 40 is seen. In FIG. 9, the closure member 30 is depicted as abutting the closure member retainer 42. The arrangement depicted in FIG. 8 would be an accurate depiction of the interaction between the closure member 30 and the closure member retainer 42 when the closure member is in the unvented position as depicted in FIG. 9. In FIG. 10, the closure member 30 is in the vented position such that a gap 46 is provided between the closure member retainer 42 on post 40 and the closure member 30. As discussed herein however, closure member retainer 42 is preferably sized and shaped such that, even in the vented position, the closure member 30 is retained on the post 40.

As discussed herein, it may be preferred that the reservoir 10 and the vent assembly features depicted in FIGS. 3 and 4 (e.g., post 40, cam surfaces 50 including aperture surface portions 52, and stops 54) may preferably be molded of thermoplastic material such as, e.g., polypropylene, the material selected to construct closure member 30 may preferably exhibit a higher level of rigidity as compared to the materials used to construct the post 40 and its associated features. For example, in one illustrative embodiment, the closure member 30 may be manufactured of, e.g., nylon, glass-filled nylon, etc. Although the closure member 30 may be molded or otherwise constructed of a single material, in one or more embodiments the closure member 30 may be constructed of multiple different materials. For example, the sealing surfaces may be provided of a material that enhances closure of the apertures 22, the stepped transition 39 of the closure member 30 may be constructed of one or more materials that enhance interaction with the closure member retainer 42, etc.

Figure 11:
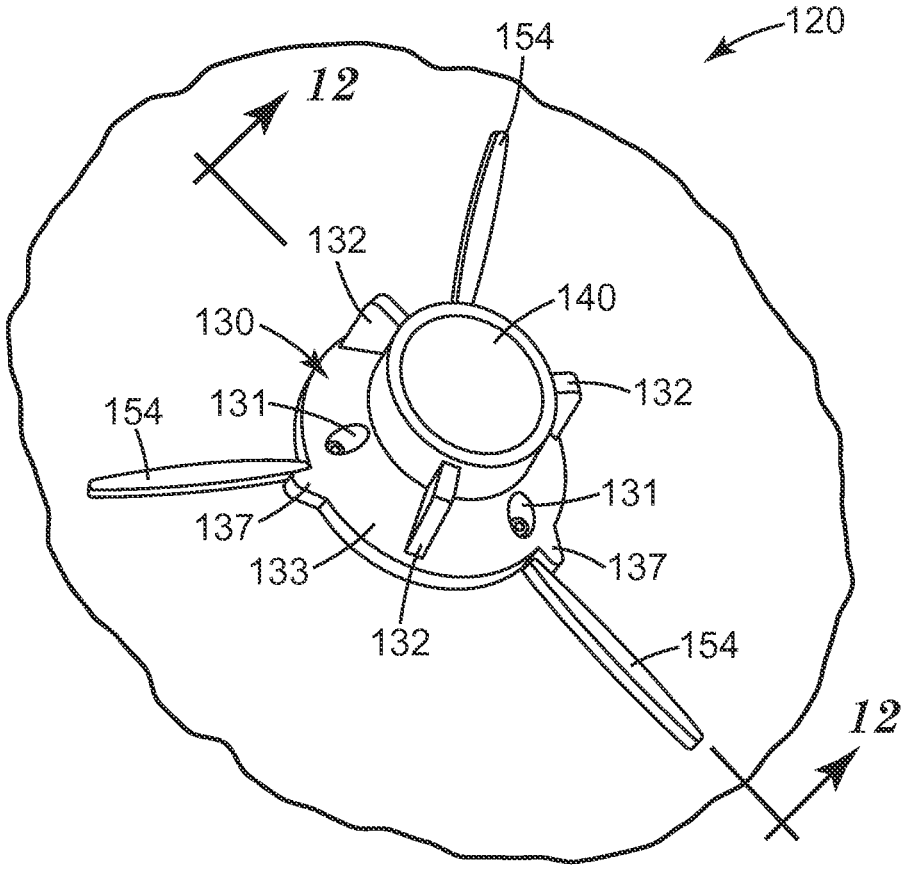
FIG. 11 is a perspective view of another illustrative embodiment of a vent assembly that may be used in the reservoirs described herein.
Figure 12:
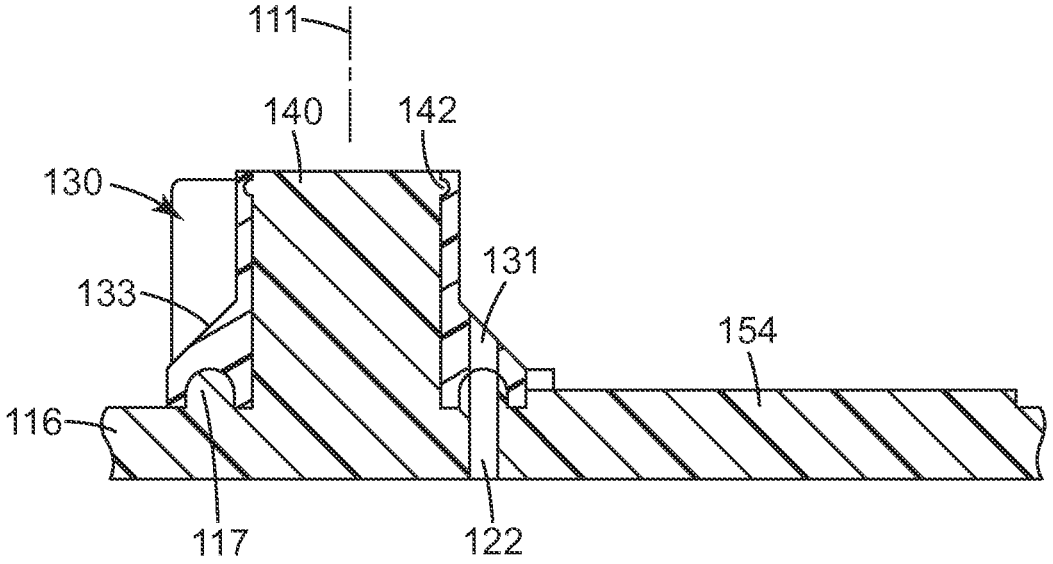
FIG. 12 is a cross-sectional view of the vent assembly of FIG. 11 taken along line 12-12 in FIG. 11.

Another illustrative embodiment of a vent assembly 120 that may be used in the reservoirs as described herein is depicted in FIGS. 11 and 12. The vent assembly 120 includes a closure member 130 mounted on a post 140 for rotation about an axis 111. The closure member 130 includes extensions 132 that are provided to facilitate manual rotation of the closure member on post 140. The closure member 130 also includes openings 131 that are provided to align with apertures 122 formed through the wall 116 when the closure member 130 is in the vented position. This alignment of openings 131 and apertures 122 is seen both in FIG. 11 and in FIG. 12.

When the closure member 130 is in the unvented position, the base 133 of the closure member 130 is positioned over the apertures 122 two limit the entry of air into the container through apertures 122. When, however, in the vented position, the openings 131 and the closure member 130 are aligned with apertures 122 two allow air to pass through apertures 122.

The base 133 of the closure member 130, in the depicted embodiment, includes an optional recess that is provided to receive a ridge 117 extending from wall 116. The ridge 117 and its corresponding recess in base 133 of the closure member 130 may improve alignment of the closure member 130 on the post 140.

Other features depicted in connection with the vent assembly 120 include stops 154 that protrude from the wall 116 and that cooperate with protrusions 137 that extend from the base 133 of the closure member 130. The arrangement of stops 154 and protrusions 137 limit rotation of the closure member 130 about the post 140 and are preferably arranged to provide a positive indication that the openings 131 in the base 133 of the closure member 130 are aligned with apertures 122 formed through wall 116 of a reservoir as described herein.

Referring to FIG. 12, the post 140 includes a closure member retainer 142 that, in the depicted embodiment, cooperates with closure member 130 to retain closure member 130 on post 140. The closure member retainer 142, in the depicted embodiment, protrudes from the post 140 and nests within a corresponding recess formed in closure member 130. It may be preferred that friction generated between the closure member 130 and the post 140 be sufficient to retain the closure member 130 in the desired position, whether that position is the vented position as depicted in FIGS. 11 and 12, or the unvented position in which the base 133 of the closure member 130 closes the apertures 122. The interference between closure member retainer 142 and the corresponding recess in closure member 130 may be a part of that friction generation.

In one or more embodiments, the vent assembly 120 may also generate a compressive force between the closure member retainer 142 and the closure member 130 such that the closure member 130 is compressed against the wall 116 of the reservoir. Any such compressive force may be generated by a difference in height between the closure member retainer 142 and the wall 116 of the reservoir and the thickness or height of the closure member 130 between the recess that receives closure member retainer 142 and the lower surface of base 133, i.e., the surface that faces wall 116.

Figure 13:
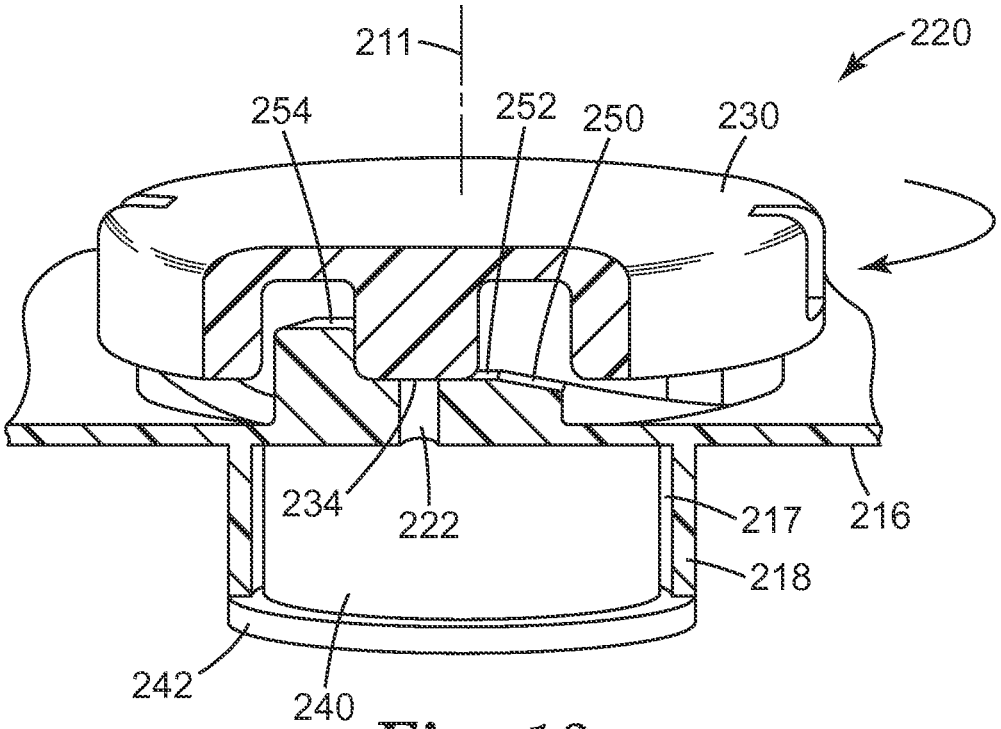
FIG. 13 is a perspective partial cross-sectional view of another illustrative embodiment of a vent assembly as described herein.

Another alternative embodiment of a vent assembly 220 as described herein is depicted in the partial cross-sectional view of FIG. 13. In many respects, the vent assembly 220 depicted in FIG. 13 is similar to the illustrative embodiment of the vent assembly 20 depicted in FIGS. 9-10. For example, the vent assembly 220 as depicted in FIG. 13 is in the unvented position in which a sealing surface 234 of the closure member 230 is located over an aperture 222. The vent assembly 220 includes a cam surface 250 that rises gradually from the wall 216 to the aperture surface portion 252 so that relatively smooth operation of the closure member 230 is achieved as closure member 230 is rotated from the vented position to the unvented position and vice versa. Rotation of the sealing surface 234 of the closure member 230 past aperture surface portion 252 is, in the illustrative embodiment, prevented by stop 254 positioned adjacent the aperture surface portion 252. Although not necessarily required, it may be advantageous to provide cam surface 250 with an aperture surface portion 252 that is relatively flat and that is located in a plane that is perpendicular to axis 211 about which closure member 230 rotates when moving between the vented and unvented positions. That orientation of the aperture surface portion 252 relative to the axis 211 may, as discussed herein, provide improved closure of the aperture 222 by the closure member 230.

The vent assembly 220 depicted in FIG. 13 includes a post 240 and a closure member retainer 242. One difference between the vent assembly 220 depicted in FIG. 13 and the vent assembly 20 depicted in FIGS. 9-10 is, however, that while the post 40 of vent assembly 20 is attached to and extends from the wall 16 of the reservoir 10, the post 240 in the vent assembly 220 is attached to the closure member 230 such that the post 240 rotates with the closure member 230 during movement of the closure member 230 between the vented and unvented positions. The post 240 extends through an aperture 217 in the wall 216 of the reservoir. The aperture 217 includes a sleeve 218 in which the post 240 resides in the depicted embodiment, but the sleeve 218 is optional and of a length selected to match the length of the post 240. In particular, the length of the sleeve 218 is selected relative to the length of the post 240 and the height of the cam surface 250 such that the proper amount of compressive force can be generated between the aperture surface portion 252 of the cam surface 250 and the sealing surface 234 of the closure member 230 when the closure member 230 is moved to the unvented position.

Figure 14:
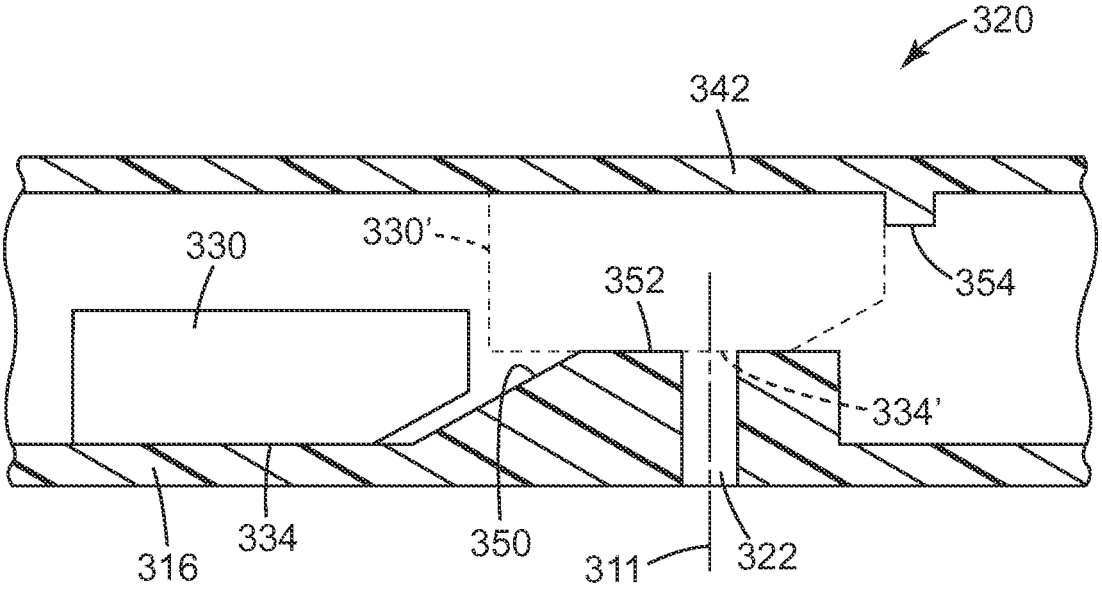
FIG. 14 is a partial cross-sectional view of another illustrative embodiment of a vent assembly as described herein.

Yet another illustrative embodiment of a vent assembly is depicted in FIG. 14. Unlike the illustrative embodiments of the vent assembly described above, the vent assembly 320 depicted in FIG. 14 includes a closure member 330 that moves in a linear or translational motion between the vented and unvented positions rather than the rotational motion used in the embodiments described in connection with FIGS. 1-13. The closure member of vent assembly 320 is depicted in both the vented position (see closure member 330 in solid lines) and the unvented position (see closure member 330' in broken lines).

The closure member 330 of vent assembly 320 is positioned in a slot or opening between closure member retainer 342 and the wall 316. An aperture 322 is provided that extends through wall 316. The vent assembly 320 also includes a cam surface 350 that rises gradually from the wall 316 to an aperture surface portion 352 so that relatively smooth operation of the closure member 330 is achieved as closure member 330 is advanced from the vented position to the unvented position and vice versa.

Movement of the sealing surface 334' of the closure member 330' past aperture surface portion 352 is, in the illustrative embodiment, prevented by stop 354 which, in the depicted embodiment, extends from the closure member retainer 342.

Although not necessarily required, it may be advantageous to provide cam surface 350 with an aperture surface portion 352 that is relatively flat and that, in the depicted embodiment is located in a plane that is perpendicular to axis 311 that extends through the aperture 322. That orientation of the aperture surface portion 352 relative to the aperture 322 and axis 311 may potentially provide improved closure of the aperture 322 by the sealing surface 334' of closure member 330'.

Illustrative embodiments of the vent assemblies and the reservoirs in which the vent assemblies may be used are discussed and reference has been made to some possible variations. These and other variations and modifications in the invention will be apparent to those skilled in the art without departing from the scope of the invention, and it should be understood that this invention is not limited to the illustrative embodiments set forth herein. Accordingly, the invention is to be limited only by the claims provided below and equivalents thereof.

What is claimed is:

1. A vent assembly comprising:

an aperture formed in a wall of a reservoir, wherein the reservoir defines an interior volume, and wherein the aperture is in fluid communication with the interior volume of the reservoir;

a closure member retained on the wall of the reservoir proximate the aperture, wherein the closure member is configured for movement between a vented position and an unvented position, wherein the closure member comprises a sealing surface that closes the aperture when the closure member is in the unvented position, and wherein the sealing surface does not close the aperture when the closure member is in the vented position;

a closure member retainer, wherein the closure member retainer is configured to retain the closure member on the wall of the reservoir when the closure member is in the vented position; and a cam surface configured to generate a compressive force on the closure member when the closure member is moved into the unvented position, wherein the compressive force forces the sealing surface of the closure member against the wall of the reservoir when the sealing surface is positioned over the aperture, wherein the closure member is configured for rotation about an axis extending through the wall of the reservoir into the interior volume when moving between the vented position and the unvented position.

2. The vent assembly according to claim 1, wherein the cam surface is located between the closure member and the wall of the reservoir, wherein rotation of the closure member from the vented position to the unvented position generates a compressive force between the closure member retainer and the cam surface such that the sealing surface of the closure member is forced against the against the wall of the reservoir when the sealing surface is positioned over the aperture.

3. The vent assembly according to claim 1, wherein closure member is mounted on a post extending from the wall of the reservoir, wherein the closure member is configured for rotation on the post; and wherein the closure member retainer is located on the post and configured to retain the closure member on the post when the closure member is in the vented position, and further wherein the compressive force is generated between the closure member retainer and the cam surface when the sealing surface is positioned over the aperture.

4. The vent assembly according to claim 3, wherein the closure member retainer comprises a shoulder extending outwardly from the post relative to the axis.

5. The vent assembly according to claim 4, wherein the closure member comprises an inner surface facing the post and a top surface facing away from the wall of the reservoir, wherein the closure member comprises a stepped transition between the inner surface and the top surface wherein a top edge of the inner surface does not coincide with an inner edge of the top surface of the closure member.

6. The vent assembly according to claim 5, wherein the shoulder of the closure member retainer contacts the top edge of the inner surface of the closure member when the closure member is in the unvented position.

7. The vent assembly according to claim 1, wherein the aperture extends through the cam surface.

8. The vent assembly according to claim 7, wherein the cam surface comprises an aperture surface portion that is located in a plane that is perpendicular to the axis about which the closure member rotates, and wherein the aperture extends through the aperture surface portion of the cam surface.

9. The vent assembly according to claim 1, wherein the reservoir comprises an opening and a detachable lid configured to close the opening when the lid is attached to the reservoir over the opening.

10. The vent assembly according to claim 9, wherein the reservoir comprises a base located opposite the opening, and wherein the aperture is located in the base.

11. The vent assembly according to claim 9, wherein the aperture of the vent assembly is located in the lid.

12. The vent assembly according to claim 1, wherein the vent assembly comprises a stop configured to limit movement of the closure member in one direction when the closure member is in the unvented position.

13. The vent assembly according to claim 12, wherein the stop protrudes from the wall of the reservoir.

14. The vent assembly according to claim 12, wherein the stop is located proximate the cam surface.

15. The vent assembly according to claim 1, wherein the vent assembly comprises a plurality of apertures and wherein the closure member comprises a plurality of sealing surfaces, wherein each aperture of the plurality of apertures is closed by a sealing surface of the plurality of sealing surfaces when the closure member is in the unvented position.

16. The vent assembly according to claim 15, wherein the closure member comprises a plurality of relief surfaces, wherein a relief surface is positioned above each aperture of the plurality of apertures when the closure member is in the vented position.

17. The vent assembly according to claim 15, wherein the vent assembly comprises a plurality of cam surfaces, and wherein each aperture of the plurality of apertures is located in a cam surface of the plurality of cam surfaces, and further wherein each aperture of the plurality of apertures is closed by a sealing surface of the plurality of sealing surfaces when the closure member is in the unvented position.

18. A method of opening and closing a vent assembly, wherein the method comprises:

moving a closure member along a cam surface between an unvented position and a vented position, wherein a sealing surface on the closure member closes an aperture when the closure member is in the unvented position, and wherein in the vented position, the sealing surface does not close the aperture;

wherein movement of the closure member from the vented position to the unvented position generates a compressive force on the closure member such that the sealing surface of the closure member is forced against the wall of a reservoir when the sealing surface is positioned over the aperture, and wherein the reservoir defines an interior volume and the closure member is configured for rotation about an axis extending through the wall of the reservoir into the interior volume when moving between the vented position and the unvented position.

19. A method of opening and closing a vent assembly, wherein the method comprises:

rotating a closure member along a cam surface mounted on a post extending from a wall of a reservoir, wherein the reservoir defines an interior volume, wherein the closure member rotates on the post about an axis extending through the post and the wall into the interior volume of the reservoir, wherein the closure member rotates between an unvented position and a vented position, wherein in the unvented position a sealing surface on the closure member closes the aperture, and wherein in the vented position, the sealing surface does not close the aperture;

and wherein rotation of the closure member from the vented position to the unvented position generates a compressive force on the closure member between a closure member retainer on the post and a cam surface on the wall of the reservoir such that the sealing surface of the closure member is forced wall of the reservoir when the sealing surface is positioned over the aperture.

20. The method according to claim 19, wherein the closure member retainer comprises a shoulder located on an exterior surface of the post, and wherein the closure member is compressed between the shoulder and the cam surface when the closure member is in the unvented position.

21. The method according to claim 20, wherein the closure member comprises an inner surface facing the post and a top surface facing away from the wall of the reservoir, wherein the closure member comprises a stepped transition between the inner surface and the top surface wherein a top edge of the inner surface does not coincide with an inner edge of the top surface of the closure member, and further wherein the shoulder of the closure member retainer contacts the top edge of the inner surface of the closure member when the closure member is in the unvented position.

* * * * *